United States Patent [19]

Thomas et al.

[11] 4,406,362

[45] Sep. 27, 1983

[54] LENS CARRYING CASE

[75] Inventors: Michael D. Thomas; Francis E. Ryder, both of Arab, Ala.

[73] Assignee: Ryder International Corporation, Arab, Ala.

[21] Appl. No.: 193,902

[22] Filed: Oct. 6, 1980

[51] Int. Cl.[3] ..... A45C 11/04

[52] U.S. Cl. ..... 206/5.1; 220/339; 220/346

[58] Field of Search ..... 206/5.1; 220/339, 346, 220/345, 351, 338

[56] References Cited

U.S. PATENT DOCUMENTS

| | | | |
|---|---|---|---|
| 3,025,950 | 3/1962 | Nathan | 206/5.1 |
| 3,089,500 | 5/1963 | Stalcup | 206/5.1 |
| 3,268,068 | 8/1966 | Le Grand | 206/5.1 |
| 3,695,280 | 10/1972 | Sturgeon | 134/166 |
| 3,770,113 | 11/1973 | Thomas | 206/5 |
| 3,822,780 | 7/1974 | Ulmer et al. | 206/5.1 |
| 3,880,278 | 4/1975 | Brown | 206/5.1 |
| 3,977,517 | 8/1976 | Kadlecik et al. | 206/5.1 |
| 3,990,579 | 11/1976 | Manning | 206/501 |
| 3,998,590 | 12/1976 | Glorieux | 21/89 |
| 4,037,940 | 7/1977 | Yates et al. | 350/247 |
| 4,091,917 | 5/1978 | Clawson | 206/5.1 |
| 4,173,281 | 11/1979 | Trought | 206/5.1 |
| 4,200,187 | 4/1980 | Thomas | 206/5.1 |
| 4,228,136 | 10/1980 | Thomas | 422/307 |

*Primary Examiner*—Joseph Man-Fu Moy

*Attorney, Agent, or Firm*—Trexler, Bushnell & Wolters, Ltd.

[57] ABSTRACT

A lens case comprises an outer case member and a drawer with "left" and "right" contact lens wells slidable on the case member. Removable caps are friction fitted over each well, the caps also being hinged to the drawer. A foldout lid with a mirror is adapted for disposition over the caps. The arrangement is such that as the drawer is shifted to the closed position in the case member, a wall of the case applies pressure to the caps through the mirror or through tapered ribs on the caps to maintain the caps sealed on the wells.

5 Claims, 7 Drawing Figures

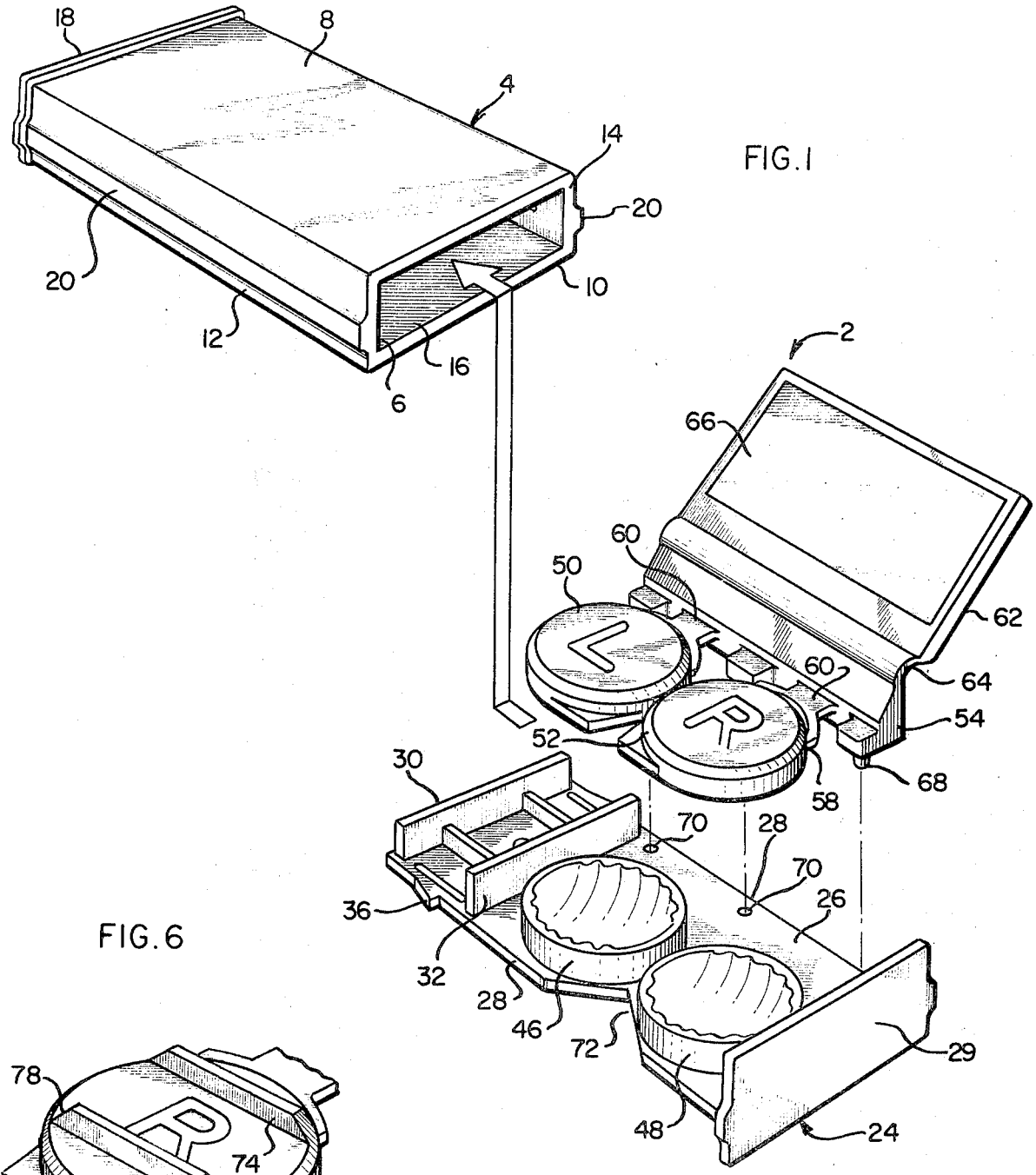
FIG. 1
FIG. 6
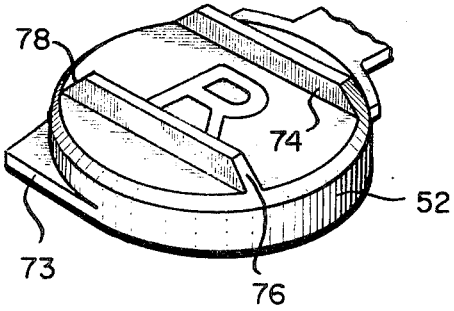
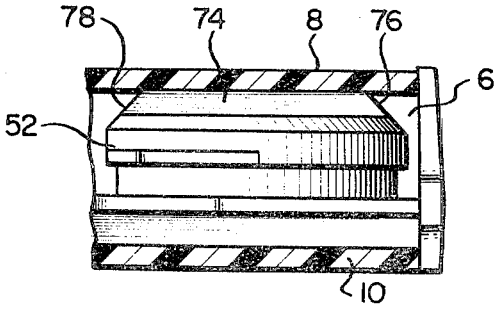
FIG. 7

LENS CARRYING CASE

BACKGROUND OF THE INVENTION

This invention relates to improvements in lens carrying cases, more particularly carrying cases for contact lenses.

Prior art contact lens cases are normally constructed with adjacent wells for storing contact lenses which are not in use. Moreover, these wells usually contain a fluid for disinfecting the lenses. Portable type lens cases are intended to be carried in a pocket-book or in a clothing pocket and for this reason it is necessary that the caps or closures for the lens wells be sealed in place; otherwise leakage will occur.

In an attempt to avoid the leakage problem these prior art lens cases normally employ a screw cap of plastic which seals over the threaded opening of the lens well. The screw cap construction is expensive and sometimes the user fails to thread the cap properly in place. Furthermore, the screw-threaded cap may be lost by a careless user.

OBJECTS AND SUMMARY OF THE INVENTION

An object of this invention is to provide a contact lens case which overcomes the foregoing deficiencies of the prior art in that the lens well cap is hinged relative to the lens well opening and is held sealed thereacross by pressure imposed on the cap when the lens case is in its closed condition, thereby eliminating the necessity for a screw cap construction.

A further object of this invention is to provide a lens case of the type stated which includes an outer case member having a cavity, and a drawer with the contact lens wells, the drawer being adapted for sliding movement in the cavity such that when the drawer is in its open position the caps are accessible to the user; however, when the drawer is in its closed or retracted position within the cavity, a wall of the outer case member imposes pressure directly or indirectly onto the caps to maintain them in sealing position across the wells.

A further and more specific object of this invention is to provide a lens cap of the type stated in which the hinged joint for each cap comprises a flexible strap that is hinged at one region to the drawer and is hinged at another region to the cap proper. This compound hinging arrangement provides an extremely flexible hinge structure for the caps to facilitate positioning the caps over and seating on the rims of the lens wells.

A still further object of this invention is to provide a lens case of the type stated in which there are undulations or ribs at the bottoms of the lens wells which minimize or reduce the possibility of scratching of the lenses when stored therein.

Yet another object of this invention is to provide a lens case of the foregoing type in which the drawer is notched intermediate the lens wells for ready access to the caps.

In accordance with the foregoing objects the lens case comprises an outer case member having a cavity, a drawer having a pair of contact lens open top wells in side-by-side relation, means for indicating that one of the wells is for the left eye contact lens and the other well is for the right eye contact lens, a cap for each well, each cap being hingedly joined to the drawer for individual selective movement from a closed position across the associated well to an open position adjacent to and projecting above the well, and cooperating means on the drawer and the outer case member for slidably mounting the drawer on said case member for movement from a closed position in which the wells with the caps closed are recessed in said cavity to an open position in which the caps are outside of said cavity, said outer case member having a top wall overlying the caps when the drawer is in said closed position.

The lens case may specifically include a lid element or cap retainer hinged relative to said drawer and being between the caps and the top wall and imposing pressure on the caps when the drawer is in the closed position to aid in sealing the caps on the wells. This cap retainer may be a structure which holds a mirror. Alternatively, there may be tapered ribs on the exterior surfaces of the caps for engaging the inside of said top wall to impose the sealing pressure on the caps when the drawer is in the closed position.

BRIEF DESCRIPTION OF THE FIGURES

FIG. 1 is an exploded perspective view of a lens case constructed in accordance with and embodying the present invention;

FIG. 6 is a fragmentary perspective view of a modified form of cap which forms part of the present invention; and FIG. 7 is a fragmentary sectional view showing the drawer with the cap of FIG. 6 received within the cavity of the outer case member.

DETAILED DESCRIPTION

Figure 2:
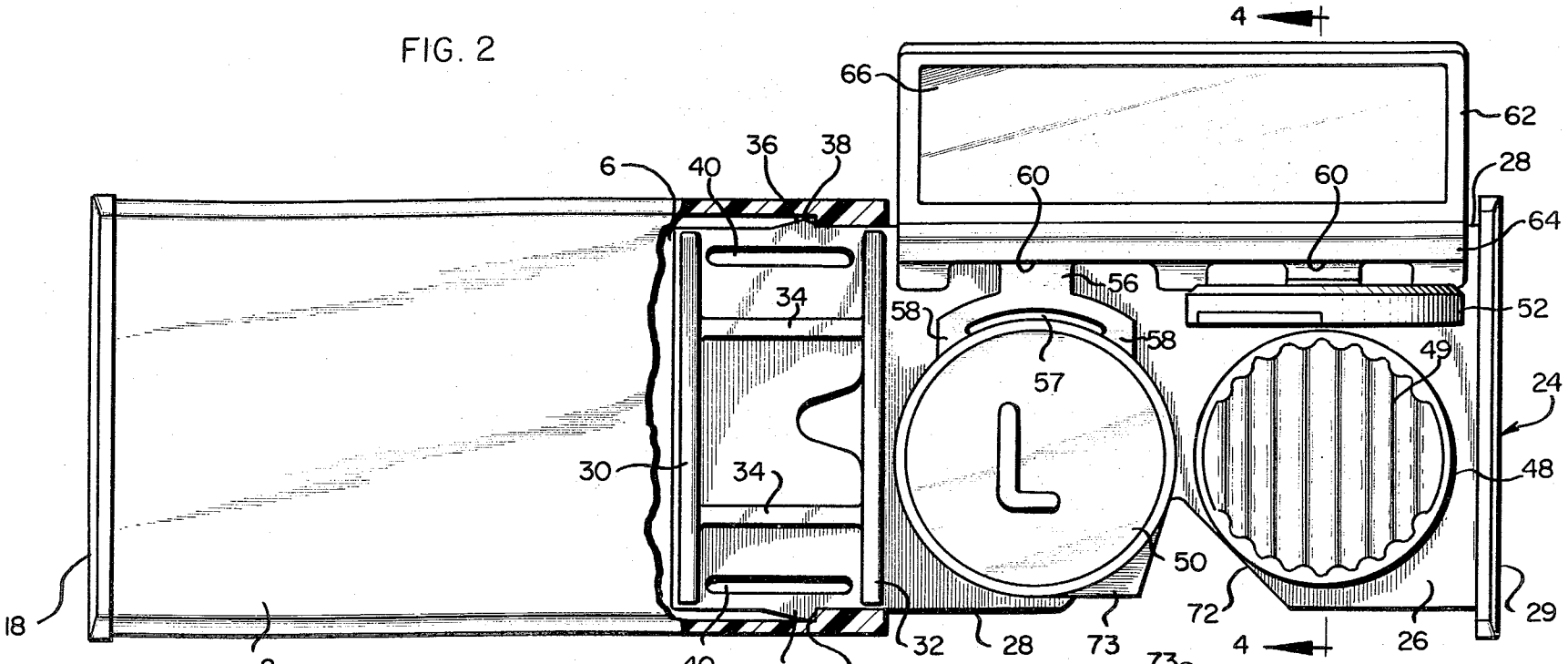
FIG. 2 is a top plan view of lens case with the drawer open and also with the cap retainer and mirror lifted upwardly and further with one of the caps removed from a lens well.

Referring now in more detail to the drawing, there is shown a lens case 2 comprising an outer plastic case member 4 of generally rectilinear configuration and which contains a rectilinear cavity 6. The outer case member 4 may be of a polycarbonate and includes a top wall 8, a bottom wall 10 parallel thereto, and short opposed sidewalls 12,14. The several walls 8,10,12,14 define an opened end 16 of the cavity 8; and the case member 4 includes an end closure wall 18 that is opposite to open end 16. Intermediate its opposite ends and somewhat nearer to the bottom wall 16 each of the sidewalls 12,14 has an outwardly projecting rib or bead 20,20 which extends substantially the full length of the respective walls 12,14. Formed in each of the beads 20,20 is an internal longitudinal slide-forming groove 22,22 for receiving a drawer 24 which will hereinafter be more fully described.

Figure 3:
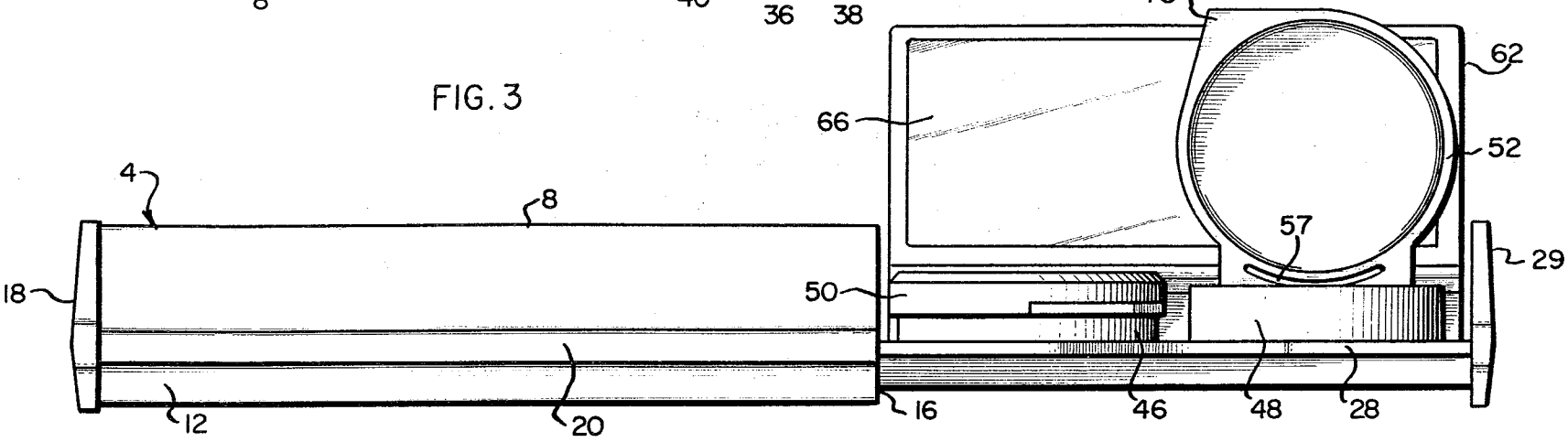
FIG. 3 is a front elevational view of the structure of FIG. 2.
Figure 5:
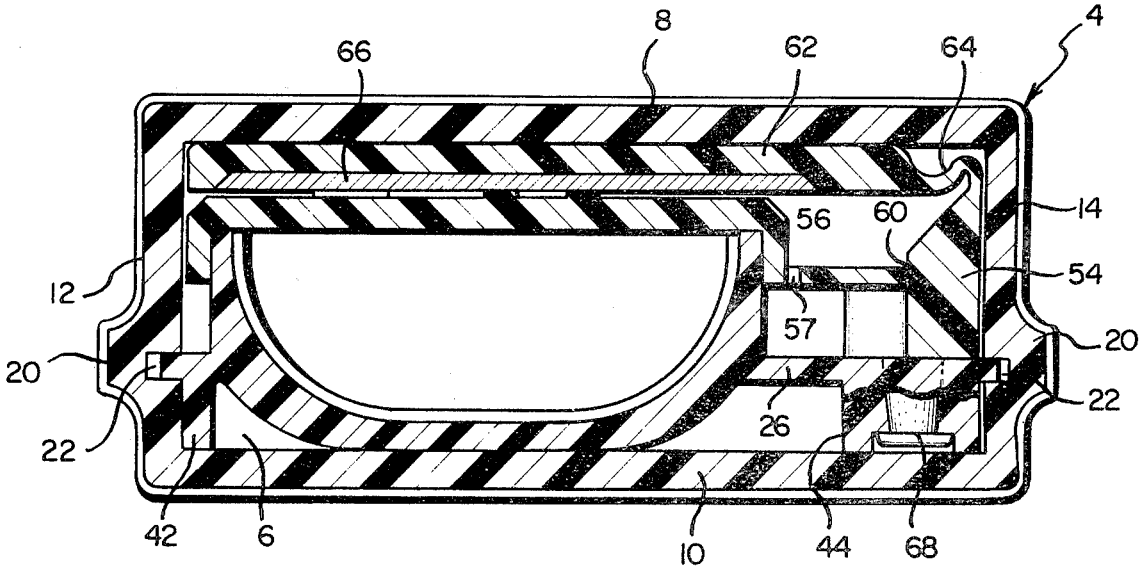
FIG. 5 is a sectional view similar to FIG. 4 but showing the caps closed and the drawer in the closed position within the outer case member.

This drawer 24 comprises a generally flat rectangular structure having a base 26 with opposed longitudinal edge portions 28,28 that are adapted to slide in the grooves 22,22 whereby the drawer 24 is slidable from a closed portion within the cavity 6, as shown in FIG. 5, to an open position as shown in FIGS. 2 and 3. The drawer may be made of a polystyrene resin. One end of the drawer 24 includes an upstanding end wall 29 that closes off the opening 16 when the drawer 24 is fully retracted within the cavity 6. At the end of the drawer 24 that is opposite to the end wall 29 there is provided a rigidifying structure which normally is contained within the cavity 6 once the drawer and outer case member 4 have been assembled. Thus, there are upstanding transverse bars 30,32 which are spaced apart and parallel and which maintain the drawer 24 and outer case member 4 in aligned relationship when the drawer is open as shown in FIGS. 2 and 3. Looked at another way, the bars 30,32 tend to prevent cocking or misalignment of the outer case member and the drawer. Also provided are spaced apart longitudinal ribs 34,34 which serve to rigidify the drawer in the longitudinal direction.

Intermediate the bars 30,32 the edges 28,28 are provided with tapered protuberances 36,36. As best seen in FIG. 2, the grooves 22,22 near the open end 16 are formed with transverse shoulders 38,38 that serve as stops and against which the protuberances 36,36 abut when the drawer is in its fully open position, as shown in FIGS. 2 and 3. In assembling the drawer with the outer case member, the tapered protuberances 36,36 will snap past the shoulders 38,38 as the drawer is pushed into the outer case member. To facilitate flexing of the protuberances 36,36 the base 26 of the drawer is formed with elongated recess 40,40 that are adjacent to the protuberances 36,36. To enhance further the structural integrity of the base 26 there are depending flanges 42,44 that slide along or are adjacent to the bottom wall 10 and the respective sidewalls 12,14.

Intermediate the bar 32 and the end wall 29 the drawer 24 is formed with upstanding generally cylindrical contact lens wells 46,48. These side-by-side lens wells have undulations in the form of grooved or ribbed interiors 49 in order to reduce the possibility of scratching of the soft contact lenses which maybe stored in the wells. The wells are provided with selectively operable caps 50,52 which are marked "L" and "R" for purposes of indicating whether the left or right eye contact lens is to be stored therein.

The cap structure for the wells forms part of a unitary molded plastic of polyethylen or polypropylene and is shown in exploded view of FIG. 1. This plastic piece comprises a body 54 to which each of the caps 50,52 is hinged. The hinged connection for each cap comprises a strap 56 that is hinged at two regions 58,58 separated by arcuate slot 57 and also to the cap proper and at a third region 60 to the body 54. The body 54 is, in turn, joined to a lid or cap retainer 62 along a flexible hinge line region 64. The cap retainer 62 may have a plastic mirror 66 which can be raised when the drawer 24 is in its open position. The mirror may be of a polycarbonate resin that is glued to the lid 62. However, when the cap retainer 62 and mirror 66 are swung to the closed position (FIG. 5) the drawer 24 may be slid to its retracted position within the outer case member 4, also shown in FIG. 5.

The hinged regions 58,60 at the strap 56 provides a highly flexible compound hinge connection for each cap. As a result, each cap may not only be pivoted but may also be moved axially so as to facilitate aligning the cap with the well and pressing the top into sealing relation with the rim of the well.

The body 54 and integrally formed cap retainer 62 and caps 50,52 are molded separately from the plastic of the drawer 24. In any event, the body 54 includes several depending pins 68 which are adapted to fit into holes 70 in the flanges 44. Upon assembly of the pins 68 within the holes 70, the pins 68 are heat sealed in place to form a permanent bond between the body 54 and the drawer 24.

Figure 4:
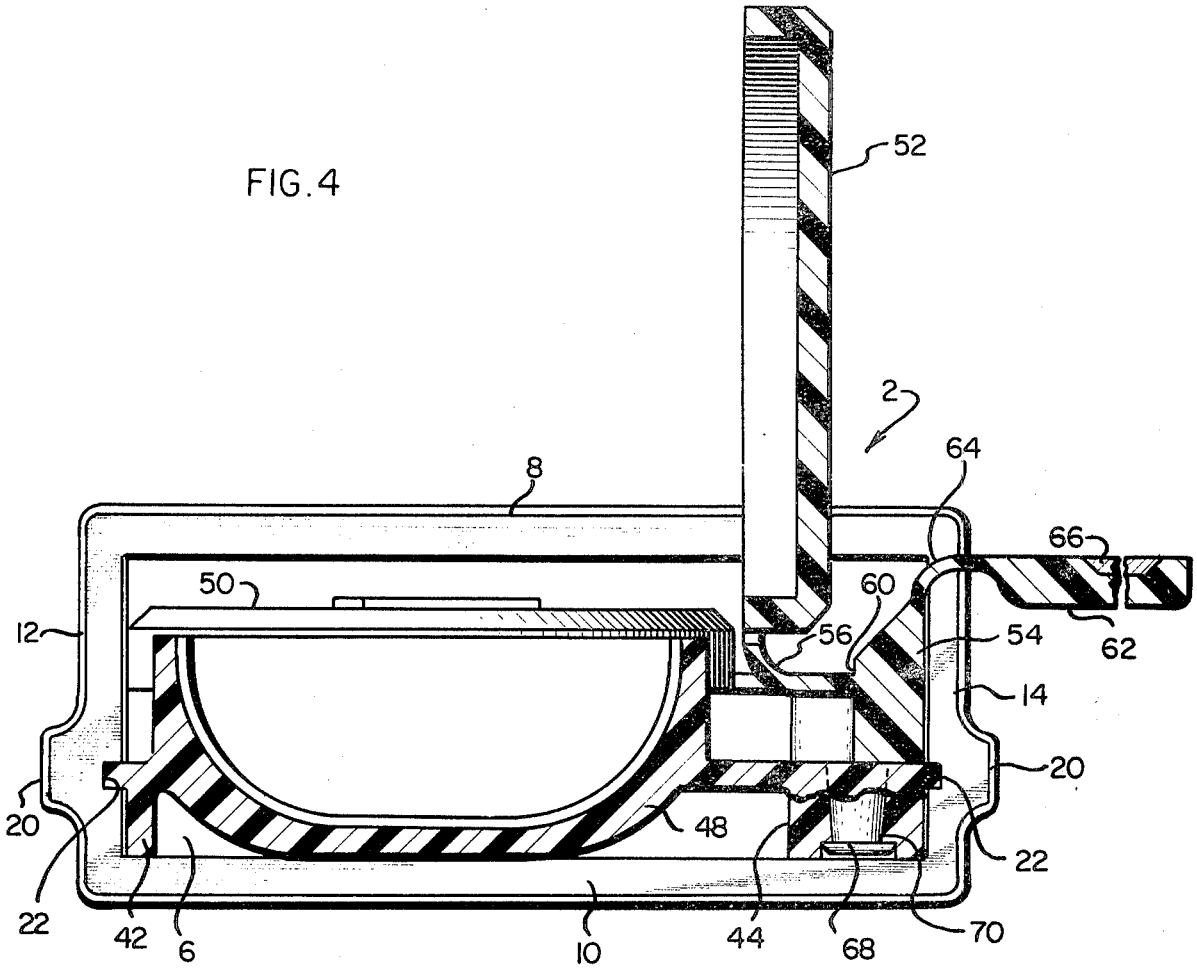
FIG. 4 is a sectional view, on an enlarged scale, taken along line 4—4 of FIG. 2 but with the mirror further unfolded as compared to FIG. 2.

As will be apparent from the foregoing, when the drawer 24 is in its open position as shown in FIGS. 2–4 access maybe had to the caps 50,52, as well as to the cap retainer 62 with its mirror 66. In such position the contact lenses may be removed from or inserted into the wells 46,48, which may contain suitable sterilizing or disinfecting fluid. The hinge 64 is sufficiently stiff that the retainer 62 and mirror 66 may be unfolded to a selected angle relative to the drawer 24. It should be noted also that adjacent to the wells 46,48 the base 26 is formed with a notch 72 that facilitates access to the caps 50,52 so that the thumb or finger of the user can be placed underneath the cap tabs 73 to push the caps off of the wells 46,48.

In closing the case the caps 50,52 are pushed down over the open top wells to form friction fits therewith. The cap retainer 62 with mirror 66 is swung over and disposed against the tops of the caps 50,52 (FIG. 5). The drawer 24 is then pushed into the outer case member 4 until the end wall 24 substantially abut the edge of the case member 4 at the open end at 16. The dimensions of the caps 50,52 as well as the thickness of the combined retainer 62 and the outer case member 4 are such that the inner surface of the top wall 10 applies pressure to the cap retainer 62 which in turn applies pressure through the mirror 66 to each of the caps 50,52. Viewed another way, the combined thickness of the retainer 62 and mirror 66 provides a slight interference fit between the tops of the caps and the underside of the top wall 8. However, the plastic will yield somewhat to allow the parts to slide relatively. The foregoing dimensions will, of course, necessitate using a modicum of force in sliding the drawer 24 to its closed position in the cavity 6. Nevertheless, because the mirror 66 is forced against the caps 50,52, the caps 50,52 are held sealed against the rims of the wells 46,48.

In the form of the invention shown in FIGS. 6 and 7, the mirror 66 and cap retainer 62 are not used. Instead, each cap 50 or 52, as the case may be, is formed with ribs 74 on its outer surface. These ribs take up the space which would normally be occupied by the combined cap retainer and mirror, and provide the means for forcing the caps 50,52 into sealed engagement with the rims of wells 46,48. Furthermore, it is desirable that the height of these ribs 74 decrease from one end 76 to the opposite end 78 thereof so that as the drawer is retracted into the cavity 6, there will be a gradually increasing pressure on the caps until the caps are moved past the open end 16. In other respects the arrangement of FIGS. 6 and 7 is similar to FIGS. 1–5, previously described.

The invention is claimed as follows:

1. A lens case comprising an outer case member having a cavity, a drawer having a pair of contact lens open top wells in side-by-side relation, each said well having an upper rim, a hingedly connected cap for each well engagable over the rim of the associated well to provide a closed sealed position and removable to open said well, cooperating means on the drawer and on said case member for slidable movement of said drawer from a closed position in which the wells with the caps are disposed within said cavity to an open position in which said caps and wells are outside of said cavity, said outer case member having a top wall, and means interposed between said caps and said top wall for imposing pressure on said caps to force said caps into sealing engagement with the upper rim of the wells when the drawer is in said closed position said means comprising a retainer member mounted to said drawer by a hinge connection, such that said retainer member may be pivoted to a position overlying said well caps and may be received within said case member when the drawer is in the closed position, said retainer member being engaged by said top wall of the casing to force the caps into sealing engagement with the upper rim of the wells.

2. A lens case according to claim 1 wherein said cooperating means further includes stop means on said drawer and outer case member for maintaining the assembled relationship of said drawer and case member and limiting the extent the drawer will extend from the case member when in the open position, such that when said drawer is in the full open position, a portion of said drawer remains within said case member serving to maintain said drawer in aligned relation with said case member and prevent cocking or misalignment thereof.

3. A lens case according to claim 1, wherein said retainer member is resiliently positioned in overlying relation to said well caps in the closed position such that when said drawer is moved to the full open position said retainer member will move out of engagement with said caps and will serve to prevent inadvertent closing of said drawer.

4. A lens case according to claim 1, wherein hinge means is provided for each cap, which comprises a flexible strap that is hinged at one end to the drawer and is hinged at the other end to said cap, said other end including a pair of tabs separated by a slot, said tabs being joined to the cap at spaced locations to provide a compound hinge connection.

5. A lens case according to claim 1, wherein said retainer member includes a mirror.

* * * * *